US006491029B2

(12) United States Patent
Kondou et al.

(10) Patent No.: US 6,491,029 B2
(45) Date of Patent: Dec. 10, 2002

(54) FUEL FEEDING DEVICE FOR FUEL INJECTOR

(75) Inventors: Yasushi Kondou, Kawasaki (JP); Toshinobu Ueoka, Kawasaki (JP); Hiroshi Yamazoe, Kawasaki (JP)

(73) Assignee: Keihin Corporation, Tokyo (JP)

( * ) Notice: Subject to any disclaimer, the term of this patent is extended or adjusted under 35 U.S.C. 154(b) by 18 days.

(21) Appl. No.: 09/761,130

(22) Filed: Jan. 16, 2001

(65) Prior Publication Data

US 2001/0018907 A1 Sep. 6, 2001

(30) Foreign Application Priority Data

Mar. 1, 2000 (JP) ..... 2000-055418

(51) Int. Cl.[7] ..... F02M 37/04
(52) U.S. Cl. ..... 123/509; 123/497
(58) Field of Search ..... 123/497, 495, 123/499, 514, 457, 459, 509; 417/423.7, 366

(56) References Cited

U.S. PATENT DOCUMENTS 5,103,793 A * 4/1992 Reise et al. ..... 123/516
5,482,021 A * 1/1996 Roche ..... 123/456
5,593,287 A * 1/1997 Sadakata et al. ..... 417/366
6,029,633 A * 2/2000 Brandt ..... 123/509
6,129,074 A * 10/2000 Frank ..... 123/509
6,298,832 B1 * 10/2001 Yamazoe et al. ..... 123/514
6,357,424 B1 * 3/2002 Sonoda et al. ..... 123/509

* cited by examiner

*Primary Examiner*—Willis R. Wolfe
*Assistant Examiner*—Mahmoud Gimie
(74) *Attorney, Agent, or Firm*—ZITO tlp; Joseph J. Zito; Kendal M. Sheets

(57) ABSTRACT

To feed stably fuel through a fuel injection valve for a long period and to stabilize pressure controlling characteristics of a fuel pressure controlling valve, a fuel case is partitioned to form a fuel introduction chamber, a pump receiving chamber and a fuel discharge chamber. A fuel pump is received in the pump receiving chamber, an intake passage thereof communicates to the fuel introduction chamber and a discharge passage is opened to the inside of a filter in fuel discharge chamber. Fuel discharged from the fuel pump is fed into the inside of the filter from the discharge passage and clean fuel is fed into a cleaned fuel discharge chamber. The clean fuel within the cleaned fuel discharge chamber is fed from a fuel discharge passage to a fuel distribution pipe and fed from a fuel introduction passage of the fuel pressure controlling valve to the fuel chamber thereof.

1 Claim, 2 Drawing Sheets

FUEL FEEDING DEVICE FOR FUEL INJECTOR

BACKGROUND OF THE INVENTION

1. Field of the Invention

The present invention relates to a fuel injector for increasing a pressure of fuel within a fuel tank by a fuel pump and feeding the boosted fuel through a fuel injection valve arranged in a fuel distribution pipe.

2. Description of the Conventional Art

A fuel injector is composed of a throttle body, a fuel distribution pipe provided with a fuel injection valve, a fuel pump, a fuel pressure controlling valve, a filter and the like. Among these components, the fuel pump, the fuel pressure controlling valve and the filter as a fuel pressure increasing portion, a fuel pressure controlling portion and a fuel filtering portion respectively, are received and disposed in a single fuel case in view of the mountability to a vehicle, assembling property and compactness. For example, this is disclosed in Japanese Patent Application Laid-Open No. 11-108700 applied by the present applicant.

SUMMARY OF THE INVENTION

An object of the present invention is to provide a fuel feeding device for a fuel injector in which a fuel pump, a fuel pressure controlling valve and a filter are arranged in a single fuel case, that can stably feed an accurately measured fuel for a long period of time through a fuel injection valve and stably control the pressure controlling characteristics of the fuel pressure controlling valve for a long period of time.

In a fuel feeding device for a fuel injector according to the present invention, in order to attain the above mentioned objects, a fuel case is partitioned to form, from one side to the other, a fuel introduction chamber, to which a fuel introduction passage is opened, a pump receiving chamber for receiving a fuel pump, and a fuel discharge chamber, to which a fuel discharge passage is opened and which receives a filter; an intake passage of the fuel pump disposed in the pump receiving chamber is opened to the fuel introduction chamber and a discharge passage of the fuel pump is in direct communication with an inside of the filter disposed in the fuel discharge chamber; a fuel pressure controlling valve is partitioned into a spring chamber and a fuel chamber by a diaphragm, a fuel introduction passage is opened to the fuel chamber, and a fuel return passage that is opened and closed by a valve that moves synchronously with the diaphragm is opened to the fuel chamber; an upstream of the fuel introduction passage of the fuel pressure controlling valve and an upstream of the fuel discharge passage are disposed to be opened in a cleaned fuel discharge chamber formed by an inside of the fuel discharge chamber and an outside of the filter; the fuel chamber of the fuel case is in communication with the fuel tank and the fuel discharge passage of the fuel case is in communication with a fuel distribution pipe provided with a fuel injection valve; the fuel return passage is in communication with a fuel tank through a pump receiving chamber and a discharge passage.

Fuel in the fuel tank is sucked into the fuel pump through a fuel introduction passage provided in the fuel case and a suction passage of the fuel pump, and the fuel whose pressure has been boosted by the fuel pump is fed directly from the discharge passage of the fuel pump to the inside of the filter received and disposed in the fuel discharge chamber. A foreign matter in the fuel is removed by the filter and the cleaned fuel discharge chamber formed by the inside of the fuel discharge chamber and the outside of the filter is thus filled with the clean fuel. Then, a part of the clean fuel in the cleaned fuel discharge chamber is fed into the fuel chamber of the fuel pressure controlling valve through the fuel introduction passage of the fuel pressure controlling valve and the remaining part of the clean fuel in the cleaned fuel discharge chamber is fed to the fuel distribution pipe through the fuel discharge passage.

DESCRIPTION OF THE PREFERRED EMBODIMENTS

Figure 1:
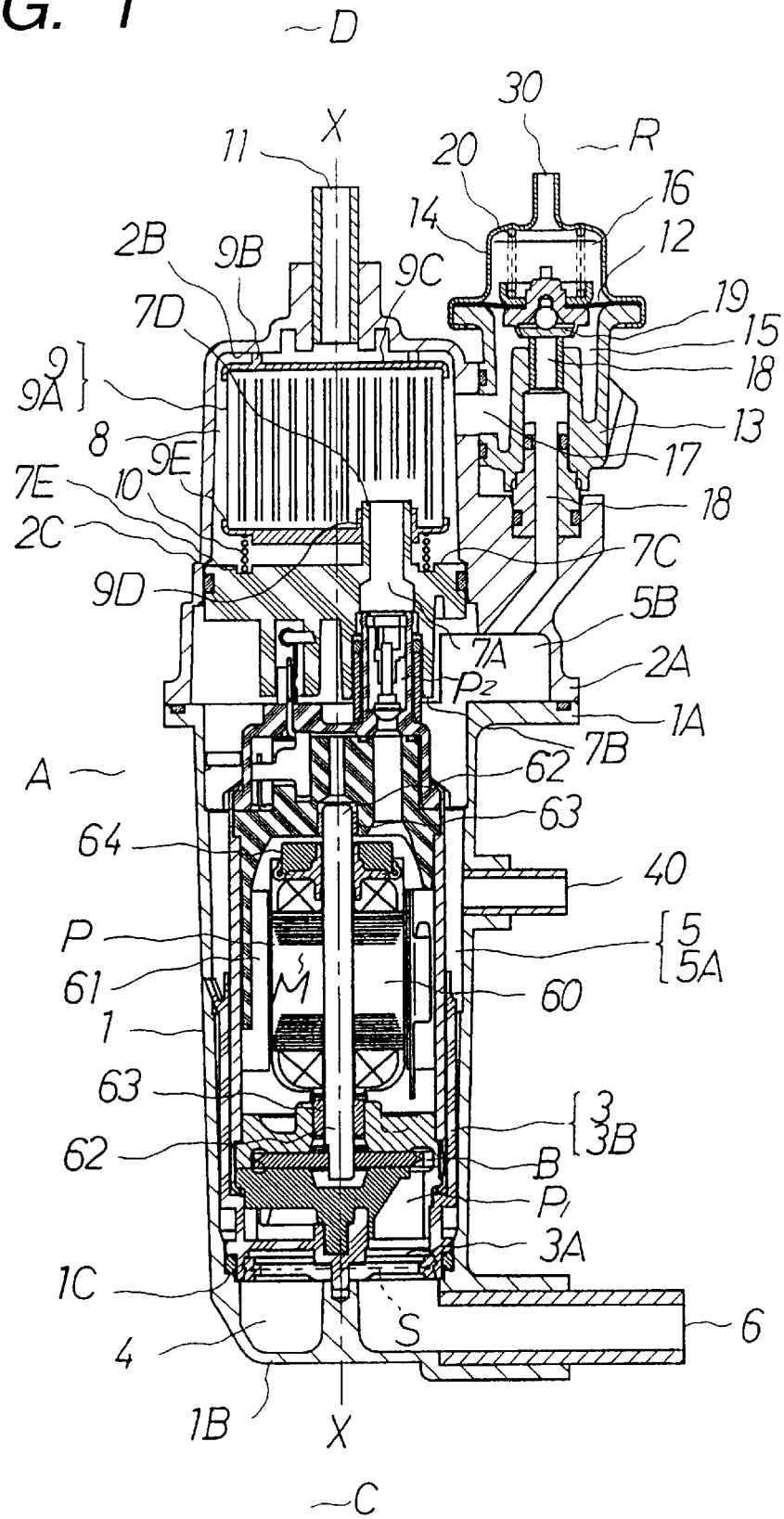
FIG. 1 is a longitudinal sectional view showing a primary part of a fuel case provided with a fuel pump, a filter and a fuel pressure controlling valve of a fuel injector for a motorcycle fuel injector in accordance with one embodiment of the present invention.
Figure 2:
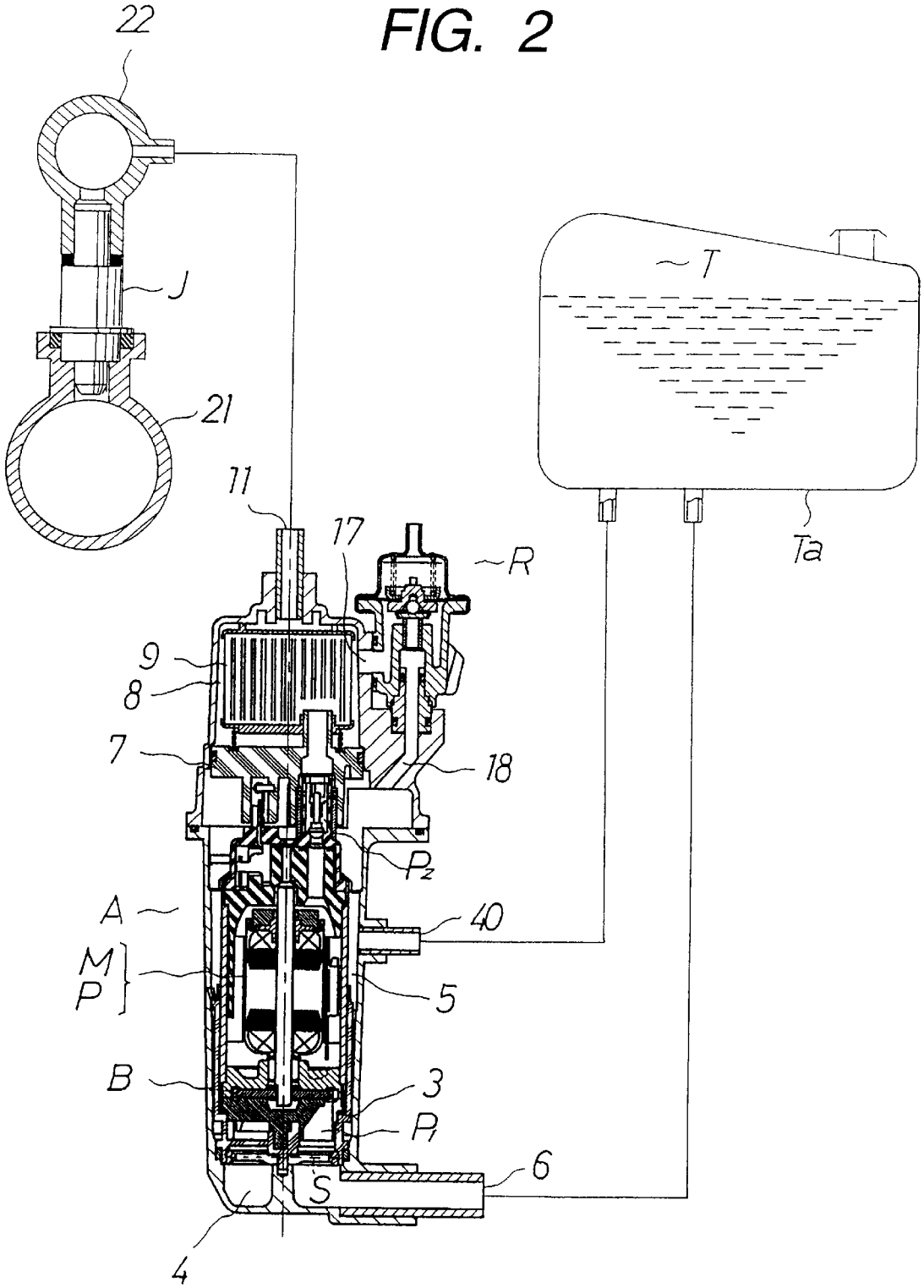
FIG. 2 is a schematic longitudinal sectional view showing a primary part of the fuel case shown in FIG. 1 in a state of being mounted on the motorcycle.

An embodiment of a fuel feeding device for a fuel injector according to the present invention will now be described with reference to FIGS. 1 and 2. A fuel case A is composed of a lower casing 1 and an upper casing 2. More specifically, the lower casing 1 has a bottomed cylindrical shape extending from an upper flange portion 1A to a lower bottom portion 1B, and the upper casing 2 has a bottomed cylindrical shape extending from a lower flange portion 2A to an upper bottom portion 2B. Then, the above-described flange portions 1A and 2A abut each other and fixed by screws (not shown) to form thereby a sealed fuel case A. Numeral 3 denotes a first annular partitioning wall member retained and disposed at a retainer stepped portion 1C formed in the vicinity of the lower bottom portion 1B of the lower casing 1. Thus, the lower casing 1 is divided into a fuel introduction chamber 4 including the lower bottom portion 1B and a pump receiving chamber 5A including the flange portion 1A. A first communication hole 3A for communicating the fuel introduction chamber 4 and the pump receiving chamber 5A with each other is formed in the bottom portion of the first partitioning wall member 3. A mesh-like annular strainer S is fitted and arranged at a lower edge of the first partitioning wall member 3. A fuel introduction passage 6 is opened to the fuel introduction chamber 4. The strainer S is located below the first communication hole 3A, and the fuel introduction passage 6 is located below the strainer S. Namely, the fuel flowing from the fuel introduction passage 6 into the fuel introduction chamber 4 is introduced into the first communication hole 3A through the strainer S.

Numeral 7 denotes an annular second partitioning wall member retained and disposed at a retainer stepped portion 2C of an intermediate portion of the upper casing 2. Thus, the upper casing 2 is partitioned into a fuel discharge chamber 8 including the upper bottom portion 2B and the pump receiving chamber 5B including the flange portion 2A. A second communication hole 7A for communicating the pump receiving chamber 5B and the fuel discharge chamber 8 is formed through in the second partitioning wall member 7. The lower portion of the second communication hole 7A is opened as a recess toward the lower end 7B of the second partitioning wall member 7, and the upper portion is projected upwardly from a top end 7C to form a passage boss 7D. An annular spring guide groove 7E is formed at the top end 7C of the second partitioning wall member 7. Then, a filter 9 is disposed within the fuel discharge chamber 8. In this embodiment, a cylindrical filter 9 is used as the filter. Describing the filter 9 more specifically, an upper disc 9C having a plurality of projections 9B at an upper end of a cylindrical filtration paper 9A is arranged and fixed in place, and a lower disc plate 9E in which an insertion hole 9D is formed at the lower end is fixed and arranged in place. This filter 9 is disposed within the fuel discharge chamber 8, and a spring 10 is compressed between the lower disc 9E of the filter 9 and the upper end 7C of the second partitioning member 7. Incidentally, the spring 10 may be compressed between the upper bottom portion 2B of the upper casing 2 and the upper disc 9C of the filter 9. With such the arrangement, the filter 9 is elastically pressed upwardly by the spring force of the spring 10. The filter 9 is positioned and fixed in place under a condition that a projection 9B provided on the upper disc 9C is brought into contact with the upper bottom portion 2B. A cleaned fuel discharge chamber 8B in a nearly annular shape is thus formed by an inside 8A of the fuel discharge chamber 8 and an outside 9F of the filter 9. Incidentally, under such the condition, the full surface of the upper disc 9C of the filter 9 is not contact with the upper bottom portion 2B but a sufficient gap exists between the upper disc 9C and the upper bottom portion 2B. Also, under this condition, the passage boss 7D projecting from the upper end 7C of the second partitioning wall member 7 is inserted and arranged within the insertion hole 9D of the lower disc 9E of the filter 9. With such the arrangement, the second communication hole 7A of the second partitioning wall member 7 is in direct communication with an inside 9G of the filter 9. (The second communication hole 7A does not communicate with the cleaned fuel discharge chamber 8B.) Numeral 11 denotes a fuel discharge passage opened to the fuel discharge chamber 8, which is vertically provided on the upper bottom portion 2B of the upper casing 2. An upstream 11A of the fuel discharge passage 11 is opened in the cleaned fuel discharge chamber 8B.

Reference character P denotes a well known fuel pump that is composed of a motor portion M and a pump portion B and is disposed within the pump receiving chamber 5 formed of the pump receiving chamber 5A of the lower casing 1 and the pump receiving chamber 5B of the upper casing 2. In this embodiment, a lower circumferential portion of a housing 65 of the fuel pump P is inserted and fixed into the cylindrical portion 3B formed upwardly from the first partitioning member 3. Then, an intake passage P1 is formed to project downwardly at the lower end of the fuel pump P and a discharge passage P2 is formed to project upwardly at the upper end of the fuel pump P. Incidentally, numeral 40 denotes a discharge passage opened to the outside from the pump receiving chamber 5. Then, as described above, the lower casing 1 and the upper casing 2 are fixed to each other with the flange portions 1A and 2A abutting each other whereby a sealed pump receiving chamber 5 composed of the pump receiving chamber 5A including the flange portion 1A of the lower casing 1 and the pump receiving chamber 5B including a flange portion 2A of the upper casing 2 is formed.

To sum up, the flange portions 1A and 2A of the lower and upper casings 1 and 2 are fixed by abutting each other to form the fuel case A. The fuel introduction chamber 4, the fuel pump receiving chamber 5 and the fuel discharge chamber 8 are partitioned and formed from one side C to the other side D of the longitudinal axis X—X within the fuel case A by the first partitioning wall member 3 and the second partitioning wall member 7 disposed in the fuel case. The fuel introduction passage 6 is opened to the fuel introduction chamber 4 and the discharge passage 40 is opened to the pump receiving chamber 5. The fuel pump P is received and arranged in place with in the pump receiving chamber 5. The intake passage P1 of the fuel pump P is opened to the fuel introduction chamber 4 through the first communication hole 3A and the discharge passage P2 is opened to the inside 9G of the filter 9 disposed within the fuel discharge chamber 8 through the second communication passage 7A and the passage boss 7D. Also, the upstream 11A of the fuel discharge passage 11 is opened to the cleaned fuel discharge chamber 8B, which is formed in an outside 9F of the filter 9 by the filter 9 being disposed in the fuel discharge chamber 8.

Reference character R denotes a fuel pressure controlling valve that is composed as follows. Numeral 12 denotes a diaphragm clamped between a housing 13 and a cover 14. A fuel chamber 15 is formed between the diaphragm 12 and the housing 13. A spring chamber 16 is separately formed by means of the diaphragm 12 and the cover 14. Numeral 17 denotes a fuel introduction passage of the fuel pressure controlling valve R opened to the fuel chamber 15. The upstream 17A of the fuel introduction passage 17 is in communication with the cleaned fuel discharge chamber 8B of the fuel discharge chamber 8. Also, numeral 18 denotes a fuel return passage opened to the fuel chamber 15. The fuel return passage 18 is opened and closed by a valve 19 formed integrally with the diaphragm 12. Incidentally, numeral 20 denotes a spring compressed within the spring chamber 16 for pressing the diaphragm 12 toward the fuel chamber 15. Also, the fuel return passage 18 is in communication with the pump receiving chamber 5 through the upper casing 2. Accordingly, when the pressure is not generated within the fuel chamber 15, the valve 19 is pressed by the spring 20 to close the fuel return passage 18. Incidentally, numeral 30 denotes a vacuum introduction passage for introducing intake vacuum pressure (to be described later) within the intake pipe.

The thus constructed fuel case A is connected and arranged to the other structure for constituting the fuel injector as follows. Character T denotes a fuel tank for reserving the fuel therein. Character J denotes a fuel injection valve clamped between a throttle body 21 and a fuel distribution pipe 22. The throttle body 21 is in communication with an engine through an intake pipe (not shown). The fuel case A is located below the fuel tank T and the respective flow passages of the fuel case A are in communication with the other components as shown below. Namely, the fuel introduction passage 6 is in communication with the fuel tank T. The fuel return passage 18 is in communication with the fuel tank T through the pump receiving chamber 5 and the discharge passage 40. Also, the fuel discharge passage 11 is in communication with the fuel distribution pipe 22. Incidentally, the fuel case A may be mounted on the throttle body 21 or the fuel tank T through a stay (not shown).

The operation will now be described. The fuel within the fuel tank T is introduced into the fuel introduction chamber 4 through the fuel introduction passage 6 of the fuel case A from a bottom surface Ta of the fuel tank T by gravity and fills the fuel introduction chamber 4. Under this condition, when the motor portion M of the fuel pump P is driven to rotate the pump portion B, the pump portion B sucks the fuel, within the fuel introduction chamber 4 from which the foreign matter has been removed by the strainer S, through the first communication hole 3A of the first partitioning wall member 3 and the intake passage P1 Subsequently, the fuel whose pressure is boosted by the pump portion B is fed into the inside 9G of the filter 9 disposed within the fuel discharge chamber 8 through the discharge passage P2 and the second communication hole 7A of the second partitioning wall member 7. The clean fuel from which the foreign matter has been removed through the cylindrical filtration paper 9A of the filter 9 is fed to the cleaned fuel discharge chamber 8B formed in the outside 9F of the filter 9. The clean fuel fed into the cleaned fuel discharge chamber 8B is introduced into the fuel chamber 15 of the fuel pressure controlling valve R through the fuel introduction passage 17 of the fuel pressure controlling valve R to push upwardly the valve 19 through the diaphragm 12 and to be balanced with the force of the spring 20 at the set fuel pressure, thereby adjusting the fuel pressure within the cleaned fuel discharge chamber 8B including the fuel chamber 15 to the set pressure. Upon the release operation of the valve 19 in the above-described upward movement of the valve 19, the fuel within the fuel chamber 15 is discharged into the fuel tank T through the fuel return passage 18, the pump receiving chamber 5 and the discharge passage 40. With such the operation, the fuel pressure within the cleaned fuel discharge chamber 8B is adjusted to the set pressure, and the adjusted fuel within the cleaned fuel discharge chamber 8B is fed into the fuel distribution pipe 22 through the fuel discharge passage 11 and injected and fed into the throttle body 21 through the fuel injection valve J to reach the engine.

With the fuel feeding device according to the present invention, it is possible to feed the fuel from the fuel injection valve in a stable and accurate manner for a long period of time and to perform a stable control of the pressure controlling characteristics of the fuel pressure controlling valve for a long period of time. The reason for this will now be described. The fuel pump P is composed of the motor portion M and the pump portion B. Among these, the motor portion M is composed of an armature 60 and a magnetic field magnet 61. A rotary shaft 62 projecting upward and downward is rotatably supported to a bearing 63. Furthermore, a brush (not shown) is in sliding contact with a rectifier 64 provided at the end portion of the armature 60. Then, when the current is supplied to the rectifier 64 through the brush, the armature 60 is rotated. The pump portion B is drivingly rotated through the rotary shaft 62. The fuel whose pressure is boosted by the pump portion B is discharged toward the discharge passage P2 through the gap defined by the inner circumference of the housing 65 and the outer circumference of the armature 60. It should be noted that there is a fear that a wear would occur in the rotary support portion between the rotary shaft 62 and the bearing 63 and the contact portion between the rectifier 64 and the brush, and the worn powder generated by the friction would be mixed into the fuel directing to the discharge passage P2.

In the fuel feeding device according to the present invention, the fuel discharged from the discharge passage P2 is once fed into the inside 9G of the filter 9 through the second communication hole 7A, the fuel including the wear powder discharged from the discharge passage P2 is filtrated through the inside 9G of the filter 9, and only the clean fuel is fed to the cleaned fuel discharge chamber 8B. The clean fuel that does not contain the foreign matter therein directing toward the fuel chamber 15 of the pressure controlling valve R through the fuel introduction passage 17 of the fuel pressure controlling valve R from the cleaned fuel discharge chamber 8B is fed for a long period of time, whereby the opening and closing operation of the valve 19 of the fuel return passage 18 can be positively attained and it is possible to obtain the pressure controlling valve R that can keep the stable pressure controlling characteristics for a long period of time. Also, as for the fuel directing to the fuel distribution pipe 22 through the fuel discharge passage 11 from the cleaned fuel discharge chamber 8B, only the clean fuel within the cleaned fuel discharge chamber 8B is fed as described above. No foreign matter may stick to an injection hole or the like of the fuel injection valve J. It is therefore possible to feed the fuel in a stable and accurate manner for a long period of time. Also, according to the present invention, the fuel return passage 18 of the pressure controlling valve R is in communication with the fuel tank T through the pump receiving chamber 5 and the discharge passage 40 and, since fuel returned to the fuel tank T is the clean fuel fed from the cleaned fuel discharge chamber 8B, any foreign matter is not brought into the fuel tank T. Accordingly, any foreign matter contained in the fuel directing to the fuel introduction chamber 4 through the fuel introduction passage 6 from the fuel tank T is not increased through the recirculation of the fuel from the discharge passage 40. Thus, the filtration ability of the strainer S would not be deteriorated. Incidentally, the shape of the filter 9 received within the fuel discharge chamber 8 is not limited to that shown in the embodiment.

As described above, in the fuel feeding device according to the present invention, the fuel introduction chamber to which the fuel introduction passage is opened, the pump receiving chamber for receiving the fuel pump and the fuel discharge chamber to which the fuel discharge passage is opened and which receives the filter are formed from one side to the other by partitioning in the fuel case. The intake passage of the fuel pump is opened to the fuel introduction chamber and the discharge passage of the fuel pump is in direct communication with the inside of the filter disposed in the fuel discharge chamber. The fuel discharge passage is opened to the cleaned fuel discharge chamber formed between the outside of the filter and the inside of the fuel discharge chamber. The fuel introduction passage of the fuel case is in communication with the fuel tank and the fuel discharge passage is in communication with the fuel distribution pipe. The fuel introduction passage of the fuel pressure controlling valve is in communication with the cleaned fuel discharge chamber. The fuel return passage is in communication with the fuel tank through the pump receiving chamber and the discharge passage. Accordingly, it is possible to feed the clean fuel to the cleaned fuel discharge chamber after the foreign matter has been removed from the fuel discharged from the fuel pump through the filter in the fuel discharge chamber. This clean fuel within the cleaned fuel discharge chamber is fed to the fuel distribution pipe through the fuel discharge passage and also fed toward the fuel pressure controlling valve. It is therefore possible to stably and accurately feed the fuel through the fuel injection valve for a long period of time. Furthermore, it is possible to perform the stable fuel pressure control by the fuel pressure controlling valve for a long period of time.

What is claimed is:

1. A fuel feeding device for a fuel injector characterized in that: a fuel case is partitioned to form, from one side to the other, a fuel introduction chamber to which a fuel introduction passage is opened, a pump receiving chamber for receiving a fuel pump, and a fuel discharge chamber to which a fuel discharge passage is opened and which receives a filter; an intake passage of the fuel pump disposed in the pump receiving chamber is opened to the fuel introduction chamber and a discharge passage of the fuel pump is in direct communication with an inside of the filter disposed in the fuel-discharge chamber; a fuel pressure controlling valve is partitioned into a spring chamber and a fuel chamber by a diaphragm, a fuel introduction passage is opened to the fuel chamber, and a fuel return passage that is opened and closed by a valve that moves synchronously with the diaphragm is opened to the fuel chamber; an upstream of the fuel introduction passage of the fuel pressure controlling valve and an upstream of the fuel discharge passage are disposed to be opened in a cleaned fuel discharge chamber formed by an inside of the fuel discharge chamber and an outside of the filter; the fuel introduction passage of the fuel case is in communication with the fuel tank and the fuel discharge passage of the fuel case is in communication with a fuel distribution pipe provided with a fuel injection valve; and the fuel return passage is in communication with a fuel tank through a pump receiving chamber and a discharge passage.

* * * * *